United States Patent [19]

Cantin

[11] Patent Number: 4,587,917

[45] Date of Patent: May 13, 1986

[54] MULTI-USE WATERCRAFT

[76] Inventor: Donald W. Cantin, 38 Archer La., Stamford, Conn. 06905

[21] Appl. No.: 619,577

[22] Filed: Jun. 11, 1984

[51] Int. Cl.[4] ..... B63B 1/00

[52] U.S. Cl. ..... 114/61; 114/39; 114/346

[58] Field of Search ..... 114/39, 61, 123, 346; 441/67

[56] References Cited

U.S. PATENT DOCUMENTS 3,161,170 12/1964 Latham ..... 114/39
3,371,636 3/1968 Sharp ..... 114/39
3,710,408 1/1973 Sorenson ..... 114/346
3,974,535 8/1976 Guanzini ..... 114/61

FOREIGN PATENT DOCUMENTS 695652 9/1965 Italy ..... 114/346

*Primary Examiner*—Trygve M. Blix
*Assistant Examiner*—Jesûs D. Sotelo
*Attorney, Agent, or Firm*—Philip M. French

[57] ABSTRACT

A watercraft having a buoyant hull provided with a centrally disposed, narrow keel and pontoons spaced at either side of the keel is surmounted by a circular deck portion on which various fittings can be disposed to allow for conversion of the hull to the specific form of a plurality of types of watercraft.

19 Claims, 11 Drawing Figures

MULTI-USE WATERCRAFT

BACKGROUND OF THE INVENTION

Participation in water sports and aquatic recreational activities is becoming more and more prevalent. People can journey with ease to the sea shore, rivers and/or lakes. This accounts in large measure for the growing interest found among young and old alike to find enjoyment and challenge on the water.

Significantly, this interest has developed despite the fact that many of the most attractive forms of aquatic recreation require costly investment in a boat as well as the expense of dockig and maintaining the equipment. In addition, diverse and popular forms of water sport and recreation have developed in a manner which associates a specific activity with a specific form of watercraft. For example, while some conventional water crafts such as surfboards can be used for simple flotation in addition to the more commonly understood and practical wind surfing or wave riding, most such vessels or vehicles are not suited for use in multiple water activities including water skiing or casual crusing. Thus an enthusiast wanting to pursue a variety of enjoyable water activities might, for example, have to own or rent a surf board, a sail boat, a canoe, a row boat and possibly even a float as an adjunct of scuba diving activity. Provision of a single multi-use watercraft which would be capable of use in a large variety of water activities is therefore desirable.

SUMMARY OF THE INVENTION

The present invention relates to a multi-use watercraft, i.e., one which can be used in a variety of water sports or activites and as any one of a number of known types of water vehicles by reason of its construction embodying features appropriate to, and as commonly found in, the separate ones of the vehicle varieties.

In accordance with the present invention, this multi-use watercraft includes a specially shaped hull designed to present optimized space utilization, buoyancy and ready adaptation for several specific use configurations by the presence of hull fittings receptive of attachments which characterize and convert the hull to particular vessel types and uses. The hull is provided as a molded component of buoyant material and has a deck portion of circular plan outline. This circular shape maximizes the space used by recreationalists. A keel, relatively deep as compared to the deck depth, is disposed beneath the deck portion and extends the diametrical expanse thereof. The keel has an upper widened merger segment where it joins the deck structure and flares inwardly therefrom downwardly so that the keel width is generally of narrow substantially uniform width for the remainder and major depth course that it follows.

A pair of pontoons are disposed symmetrically at either side of the keel in generally parallel relation therewith, the pontoons having equal lengths which can be of lesser or greater length than the keel length. The pontoons provide nearly all the buoyancy in the hull. In plan outline, they are generally elliptical in shape, while in vertical sectional outline they present an inverted triangle, the sides of which follow arcuate courses to merger one with the other at a distance ordinarily below the lower edge of the keel. The buoyancy imparted to the hull by the pontoons allows a condition of hull floatation in which the deck portion is normally spaced a distance above the water surface, thus presenting freeboard beneath the deck and in the spaces between the keel and pontoons.

This combination of elliptical and triangular aspects for the pontoons is believed to produce a particularly desirable effect for certain uses of the present watercraft. As the craft passes through the water at increased speeds, it appears that they cause the craft to lift and/or plane. This in turn reduces resistance to the passage of water and optimizes the speed obtainable.

A sheath of a waterproof material covers the entire outer surface of the hull structure, while being in intimate contact therewith by reason of the sheath material being adhered to the buoyant material or the latter having been introduced into a sheath shape and expanded therein. Although it may be formed of discrete sections, the sheath should form a continuous outer shell which is water-tight. The sheath also strengthens the hull structure, buffers the buoyant material from wear and damage and allows for effective securement of various fittings to the hull as will be described next.

A plurality of fittings of various description are carried on the deck structure. Such fittings are in specific forms provided in association with certain of the uses to which the hull can be adapted and themselves serve to receive attachments which characterize the hull use. For example, one or more fittings are located in the approximate geometric center of the deck structure and serve as sockets for reception of a universal joint to which can be attached a wind surfing sail. Such fittings convert the hull to a wind surfing craft. Others of said fittings can be employed as sockets in conjunction with reception of a conventional mainsail to convert the hull to, e.g., cat boat use. In the last mentioned instance, the fittings would ordinarily be disposed adjacent the periphery of the deck portion and, in an advantageous embodiment of the hull, the fitting for board sailing and conventional mainsail adaptation are arrayed on a line of such fittings along the course of the keel.

Additional fittings can be disposed symmetrically of the keel, adjacent the deck periphery, to serve as receptions for oarlocks thereby to convert the hull for row boat use. A gudgeon post for reception of a rudder and/or a drive motor can be provided on the deck structure. Further fittings for other use conversions of the hull will be described later in the description.

The advantages and many further features of the invention will be more apparent from the following detailed description. They are described in terms of such features of construction, combination of elements and arrangement of parts as are examplified in the construction there set forth. These exemplifications are not limitative however and the scope of the invention will be indicated in the attached claims.

BRIEF DESCRIPTION OF THE DRAWING

The invention will appear more clearly from the following detailed description when taken in conjunction with the accompanying drawings in which.

Throughout the following description, like reference numerals are used to denote like parts in the drawings.

DETAILED DESCRIPTION OF PREFERRED EMBODIMENTS

Figure 1:
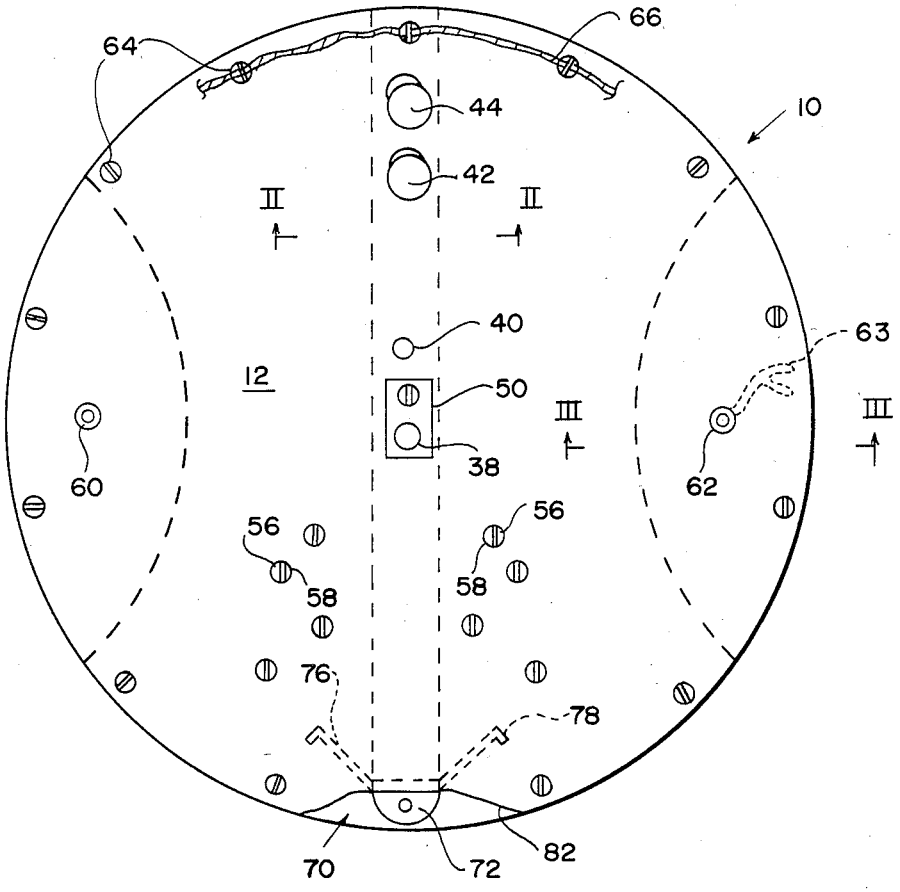
FIG. 1 is a top plan view of a multi-use watercraft constructed in accordance with the principles of the present invention.

Referring now to FIGS. 1 and 4–6, the multi-use watercraft of the invention includes a hull 10 provided as a molded component of a buoyant material such as an expanded polystyrene foam and covered over its entire outer surface with a sheath 11 of a waterproof, strengthening material, most notably a sheath of fiberglass or, more preferably, a thermoplastic resin such as ABS copolymer. The hull 10 includes a deck portion 12 of circular plan outline with the deck top surface 15 being generally of flat planar expanse but curving in the generally rounded contour as at 14 at the circumferential periphery of the deck portion. As best noted from FIGS. 4 and 5. This rounded contour presents a surface minimizing exposure to injury by those climbing aboard the hull from the water. The hull includes a centrally disposed keel 16, which as seen from FIG. 2 has a widened upper merger segment 18 where it joins the deck portion but then markedly flares inwardly so that it is of generally narrowed and substantially uniform width for the remainder and major course depth thereof, such narrowed section 20 providing reduced resistance in its underwater part while at the same time providing enhanced stability characteristics for the hull.

Figure 4:
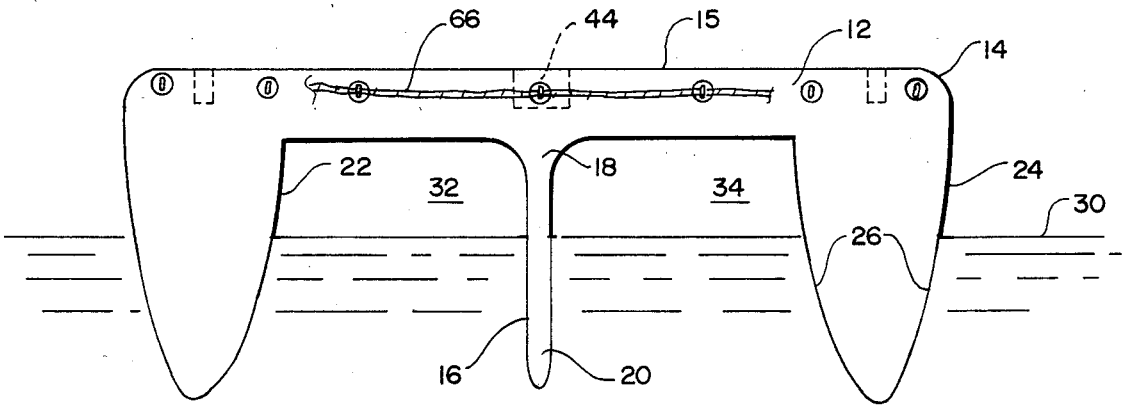
FIG. 4 is a fore end elevational view of the watercraft.
Figure 3:
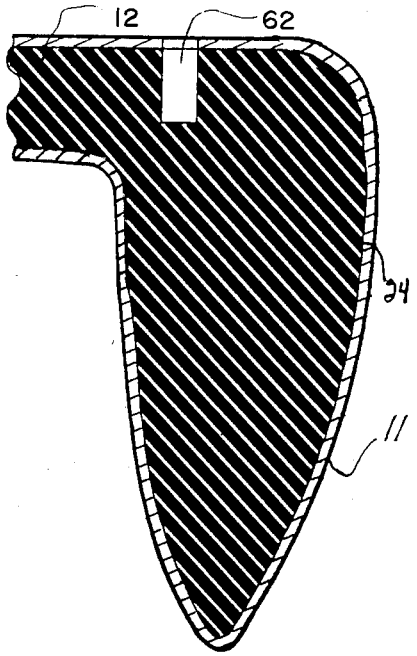
FIG. 3 is a sectional view or enlarged scale as taken along the line III—III in FIG. 1.
Figure 5:
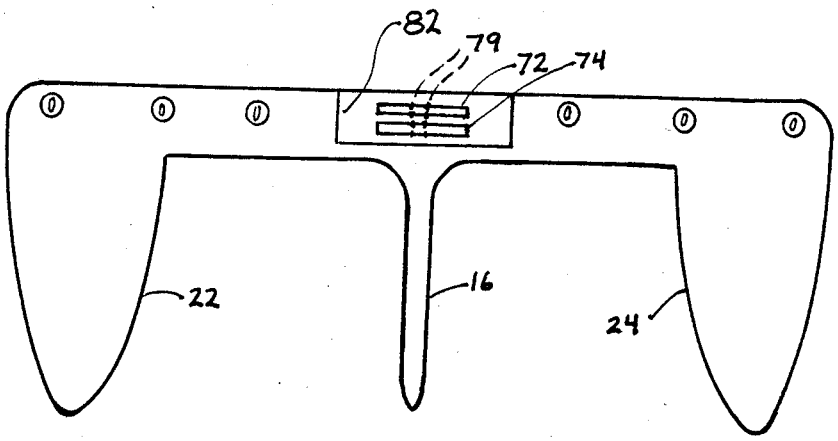
FIG. 5 is an aft end elevational view of the watercraft.

Disposed symmetrically on either side of the keel 16 are pontoons 22, 24 which depend downwardly a distance from deck position 12 to the underwater terminus, generally slightly below the lower edge of the keel. In plan outline and in the FIG. 1 embodiment, the pontoons 22, 24 are of generally elliptical shape and, as can be best seen from FIGS. 3–5, are in vertical sectional shapes formed as inverted triangles, the sides of which curve inwardly in arcuate course as at 26 to merger underwater. The pontoons 22, 24 are sized such that substantially all floatation (desirably at least 80%) is produced by the pontoons (as opposed to the keel) and the condition of hull flotation exists in which the deck portion is spaced a distance above the surface of the water 30 and a condition of freeboard obtains in the spaces 32, 34 intermediate the pontoon and the keel.

Being relatively larger in volume than and predominating over the keel 16, the pontoons 22, 24 also provide two further advantages. Firstly, they stabilize the watercraft. This effect is particularly pronounced when the craft is utilized in a sailing mode. Secondly, they create a twin-hull effect as compared to a keel alone. The resultant increase in relative waterline length thereby permits greater speeds than could otherwise be reached.

Figure 2:
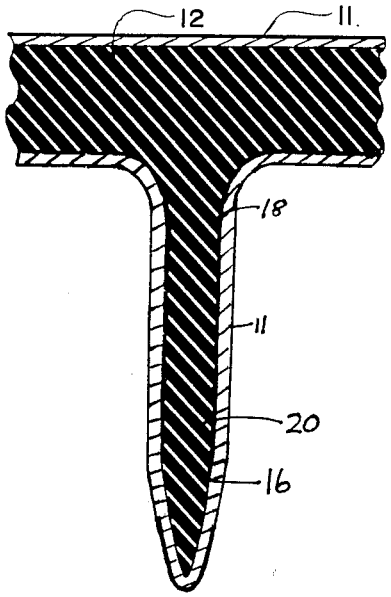
FIG. 2 is a sectional view or enlarged scale as taken along the line II—II in FIG. 1.

In the FIG. 1 hull form in actual embodiment, the deck portion was 2 meters in diameter, the keel 18 extending such full diametrical expanse. The pontoons used were of lesser length than the keel, the keel being about 7 centimeters longer at each end than the pontoons. Also and inclusive of the sheath weight, the hull weighed between about 25 kilograms when fitted into the soon to be described fittings and in use could easily support an "in water" loading of 400 kilograms or more. It will be appreciated that the actual embodiment parameters noted allow for easy handling of the hull and ready mounting on an automobile roof rack. The hull is ideally suited for the intended uses and watercraft conversion to be described later since the average user has no difficulty in transporting the hull to a recreation area distance from his home.

Figure 6:
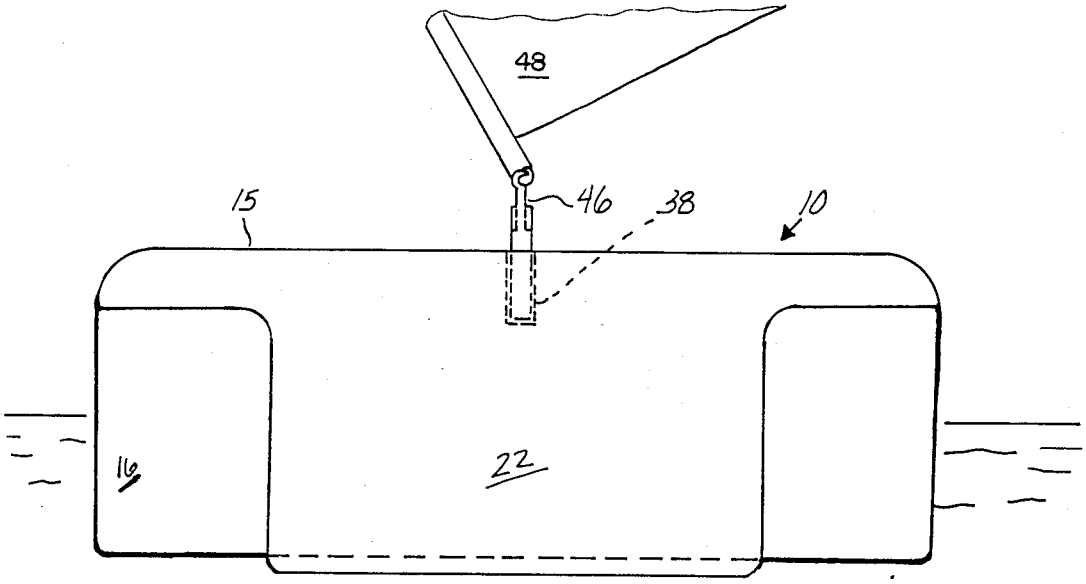
FIG. 6 is a port side elevational view of the watercraft as converted to use for board sailing.

In adapting or converting the hull 10 to a particular type of watercraft, this invention provides that various fittings maybe carried on or mounted in the hull and in a manner associated with particulars ones of the large variety of uses to which the hull can be put. In conjunction with these fittings, specific attachments are then employed as needed to produce the watercraft configuration desired. With reference to FIG. 1, a line of fittings 38, 40, 42 and 44 are disposed along the keel line and extend downwardly a distance from the top surface of the deck portion 12. Such fittings are provided in the form of sockets. Two of these fittings 38 and 40 are ordinarily associated with conversion of the hull to sailing board use and are disposed proximate the geometric center of the deck portion. The sockets 38, 40 may receive a universal joint 46 of the type commonly employed with board sailing sails and as depicted in FIG. 6. Such a universal joint is itself a further receptor for the wind surfing sail pole 48. Selectively, the user can position the universal joint member 46 in either one of sockets 38, 40 depending on use preference and or weather condition. With this arrangement the user can participate in the fully enjoyable sport of wind surfing. Because of the dual consideration of center location of sockets 38, 40 on the deck portion and the "double ended" shape of the hull, the user readily can follow the wind while surfing. In particular, he can assume a reciprocal course direction at a moment's notice since all he need do is alter the sail positioning because the "bow" and "stern" of a double ended hull are interchangeable. This contrasts with conventional surfboard vehicles where, to effect a reciprocal course change, the surfboard itself must be turned. A keeper plate 50 can be secured to the deck portion to prevent the universal joint 46 from lifting out of the socket 38, 40 in which it has been received.

Figure 7:
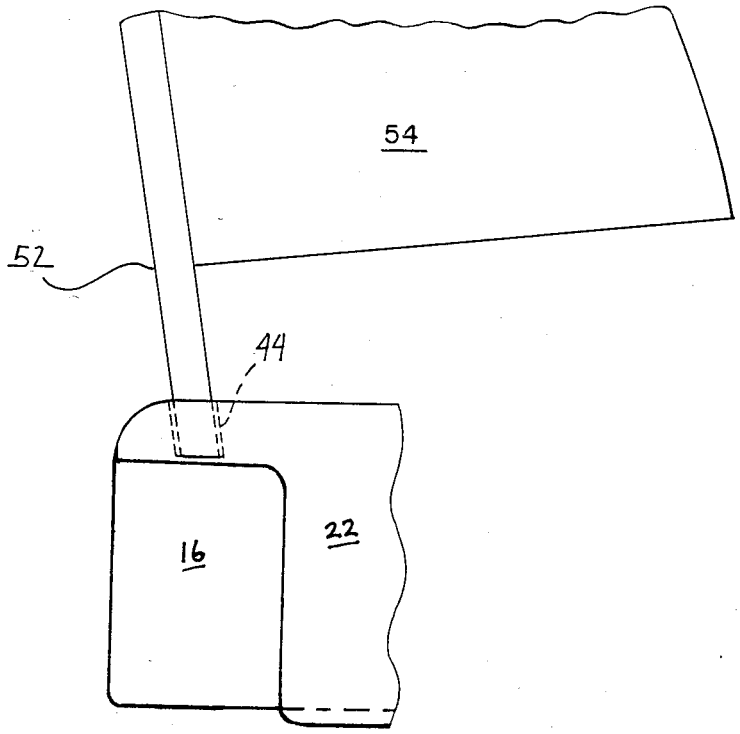
FIG. 7 is a fragmental elevated view of the watercraft depicting it as converted for use as a conventional sailboat.

The sockets 42, 44 are enlarged in relation to the sizes of sockets 38, 40 and also are designed adjacent the periphery of the deck portion 12 defining what can be termed a "bow" or fore end of the hull. These sockets are employed when it is desired to convert the hull to sailboat use, the rig therefor being a cat-rig as depicted in FIG. 7 in which a mast 52 carrying sail 54 is received in one of the sockets 42, 44.

Other fittings found on the deck portion include symmetrically arranged recesses 56 with eyes 58 or tie down rods to which can be secured footstraps of the kind used when water skiing or slaloming. These recesses are disposed at the side of the deck portion's geometric center which is remote from fittings 42, 44.

To convert the hull for rowing, a pair of fittings 60, 62 are arranged one on either side of the keel line adjacent the dock periphery. They serve to receive oarlock attachments 63.

With suitable anchoring of the hull 10, it can serve as a tether, floating pier or the like. To facilitate such use, the deck portion 12 is provided with a circularly spaced array of fittings 64 adjacent the deck periphery and through which can be received a line 66, only a portion of the line being shown. Tie-up can be effected by boats securing to the line 66. This line also serves as a safety line to be grasped by persons in the water.

Figure 8:
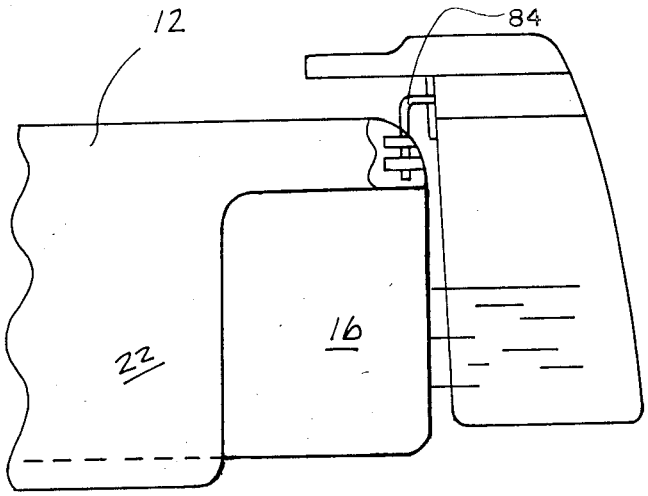
FIG. 8 is a fragmentary elevational view showing the manner in which a rudder can be attached to the hull.

Referring now in detail to FIGS. 1, 5 and 8, the aft end of the deck structure 12 is provided with gudgeon structure 70. In one form, this structure 70 can constitute a pair of spaced apart plates 72, 74 suitable received into the deck plate structure and having reinforcing rods 76, 78, the plate end having an opening 79 aligned with that of the other plate. A recessed flaring 82 is formed at the point of plate mounting to provide clearance for attachment of devices such as a rudder (FIG. 8) or an outboard motor when the hull is to be used for powered cruising. FIG. 8 show how the pintles 84 of a rudder can be inserted in the plate 72, 74 to effect rudder mounting.

Figure 9:
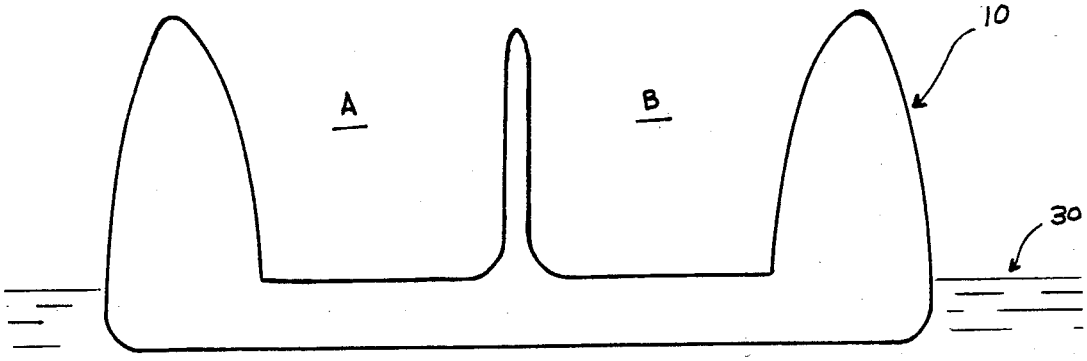
FIG. 9 is an elevational view depicting the watercraft as inverted for sunbathing purpose.

It readily can be understood that with the specified hull construction provided by this invention, the water sports enthusiasts have a wide opportunity for use of same. In addition to the conversion and uses already described, the hull can readily be adapted for us as a sun and shade deck by mounting an umbrella in a socket, it can served as a diver's platform, a floating platform for use in playing aquatic games, e.g. serving as mounting for a water polo basket. The hull being lightweight, it can also be beached to serve as a table for a picnic. It further can be inverted in the water as illustrated in FIG. 9 and floats sufficiently high in such condition to provide separate sunbather's compartments A and B.

The present watercraft may be produced by techniques used commercially in the manufacture of other craft such as surfboards and wind surfers. A preferred technique involves separately molding a deck portion and a hull portion from sheets of a thermoplastic resin such as ABS copolymer. These portions represent the skin or sheath of the craft. The separately molded portions are then joined in conventional manner at their perimeters and the resultant cavity filed with a foamable polymer such as polystyrene or polyurethane resin. Besides ensuring buoyancy, the resin foam binds directly to the skin, thus increasing the structural strength of the watercraft.

Figure 10:
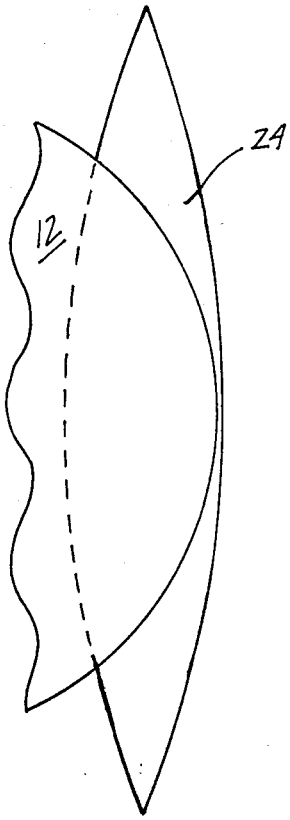
FIG. 10 is a fragmentary plan view showing the utilization of extra-long pontoons on the hull.
Figure 11:
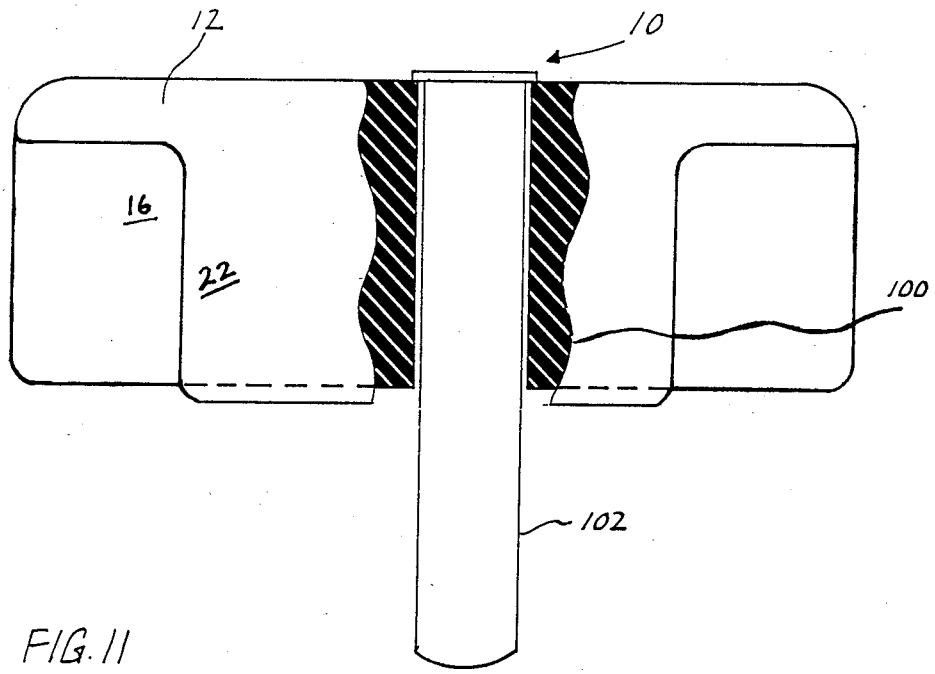
FIG. 11 is a fragmentary side elevational view depicting the manner in which a daggerboard can be received in the hull.

While there are disclosed only certain embodiments of watercraft in the foregoing description, it will be understood that additional modifications can readily be made therein without departing from the scope of the inventive concept. For example, the pontoon lengths 22, 24 can be made greater than that of the keel 18 as shown in FIG. 10. Also and particularly applicable when the hull is used for sailing, a through slot 100 as shown in FIG. 11 can be passed through from the deck portion 10 and the keel 18 to allow for reception of a daggerboard 102.

It should simiilarly be appreciated that all of the special use fittings described herein need not be incorporated into such a watercraft. The particular number and choice of such fittings are variable, depending upon individual preference.

Thus, it is to be understood that the foregoing disclosure describes only a preferred embodiment of the present watercraft. The full scope of that invention is defined by the appended claims. 9n

What is claimed is:

1. A multi-use watercraft comprising a hull having as a molded component of buoyant material, a deck portion of circular plan outline, a keel disposed beneath said deck portion extending the diametrical expanse thereof, said keel being relatively deep as compared to the depth of the deck portion and flaring inwardly from a widened upper merger thereof with the deck portion to a section of generally narrow substantially uniform width for the remainder and major depth course thereof, pontoons depending from said deck portion symmetrically at either side of said keel in generally parallel relation therewith, the pontoons having longitudinal expanses of equal dimensions, said pontoons in plan outline being elliptical in shape and in vertical sectional outline being substantially the shape of an inverted triangle, the sides of which follow arcuate courses to merge one with the other at a distance below the deck portion, the pontoons being sized such as to provide a condition of hull flotation in which the deck portion is spaced a distance above the water surface, a continuous sheath of a waterproof material intimately covering the outer surfaces of said deck portion, keel and pontoons, and a plurality of fittings carried on said deck portion and adapted for removably receiving attachments associated with use of the hull as a specific one of multiple forms of watercraft.

2. The watercraft of claim 1 in which said deck portion has a substantially flat upper surface.

3. The watercraft of claim 2 in which said deck portion upper surface transits from a flat surface to downward rounded surface at the circumferential edge of said deck portion.

4. The watercraft of claim 3 in which the pontoons extend below the lower edge of the keel and are of lesser length than said keel.

5. The watercraft of claim 4 in which said hull is sufficiently buoyant such that when inverted in the water, the spaces between the pontoons and said keel are wholly disposed a distance above the water surface.

6. The watercraft of claim 3 in which said plurality of fittings include a series of fittings disposed around the deck portion periphery in the downwardly rounded surface part thereof and constitute means for attachment of a safety line to the hull.

7. The watercraft of claim 1 in which the pontoons are of greater length than said keel.

8. The watercraft of claim 1 in which the pontoons are of lesser length than said keel.

9. The watercraft of claim 8 in which the pontoons extend at opposite ends thereof to the circumferential periphery of said deck portion.

10. The watercraft of claim 1 in which certain of said fittings comprise a plurality of sockets extending downwardly in said deck portion in alignment along the keel line of said hull.

11. The watercraft of claim 10 in which said line of certain fittings is disposed in a course from the geometric center of said deck portion towards and terminating adjacent the periphery of said deck portion and at a location defining a fore end of said hull.

12. The watercraft of claim 11 in which the sockets proximate said geometric center are adapted for reception of a board sailing sail.

13. The watercraft of claim 11 in which the sockets designed closest the periphery of said deck portion are enlarged in size as compared to those proximate the geometric center and are adapted for reception of a mainsail.

14. The watercraft of claim 11 in which said deck portion at a location diametrically opposed to said fore end and which defines a hull aft end is provided with a gudgeon post receptive of the pintle member on one of a rudder and a propulsion motor.

15. The watercraft of claim 14 further comprising two groups of additional fittings arranged intermediate said aft end and the deck geometric center and constituting tie-down means for securment of user footstraps thereto.

16. The watercraft of claim 10 comprising an additional pair of fittings disposed symmetrically one on either side of the keel line adjacent the deck portion periphery at opposed diametrical location and adapted to receive oarlocks.

17. The watercraft of claim 1 in which said deck portion and the keel are provided with a common elongated vertically disposed through slot constituting a daggerboard slot, and a daggerboard receivable in said slot and extending downwardly an appreciable distance below said keel.

18. The watercraft of claim 1 in which the buoyant material is one of foamed polystyrene and polyurethane.

19. The watercraft of claim 18 in which the sheath material is one of an ABS copolymer and fiberglass.

* * * * *